United States Patent [19]

LaBate

[11] 3,942,775

[45] Mar. 9, 1976

[54] SUBMERGED DESULPHURIZATION DEVICE AND METHOD

[76] Inventor: Micheal Donald LaBate, 115 Hazen Ave., Ellwood City, Pa. 16117

[22] Filed: July 29, 1974

[21] Appl. No.: 492,485

Related U.S. Application Data

[63] Continuation-in-part of Ser. No. 347,557, April 2, 1973, abandoned.

[52] U.S. Cl. ..... 266/34 T; 75/53

[51] Int. Cl.[2] ..... C21C 7/00

[58] Field of Search ..... 266/34 T; 75/52–58

[56] References Cited

UNITED STATES PATENTS

| | | | |
|---|---|---|---|
| 40,472 | 11/1863 | Gerhardt | 266/34 T |
| 1,876,732 | 9/1932 | Neuhauss | 266/34 T |
| 2,005,540 | 6/1935 | Fleming et al. | 266/34 T X |
| 2,776,206 | 1/1957 | Klingbeil | 266/34 T X |
| 2,809,886 | 10/1957 | Klingsbeil | 266/34 T X |
| 3,212,749 | 10/1965 | LaBate | 164/53 X |
| 3,322,530 | 5/1967 | Nakamura | 266/34 T X |
| 3,585,025 | 6/1971 | Obst et al. | 75/58 |
| 3,784,177 | 1/1974 | Rocher et al. | 266/34 T |

FOREIGN PATENTS OR APPLICATIONS

| | | | |
|---|---|---|---|
| 765,254 | 1/1957 | United Kingdom | 266/34 T |
| 997,566 | 7/1965 | United Kingdom | 266/34 T |

*Primary Examiner*—Gerald A. Dost
*Attorney, Agent, or Firm*—Webster B. Harpman

[57] ABSTRACT

A ladle for receiving molten metal is equipped with an apparatus for introducing addition agents into molten steel in the ladle and takes the form of a hollow plunger partially formed of consumable material and serving to introduce the addition agents into the molten metal at a constant predetermined rate.

6 Claims, 2 Drawing Figures

SUBMERGED DESULPHURIZATION DEVICE AND METHOD

This application is a continuation-in-part application of Ser. No. 347,557, filed Apr. 2, 1973, and now abandoned.

BACKGROUND OF THE INVENTION

1. Field of the Invention

This invention relates to apparatus for introducing an addition agent into molten steel at a desirable location and introduction rate.

2. Description of the Prior Art

Prior apparatus includes a cylindrical device having a plurality of superimposed compartments, each of which contains different addition treating agents as disclosed in U.S. Pat. No. 2,915,386. U.S. Pat. No. 3,168,608 discloses a heavy aluminum weighted device for introducing aluminum into molten steel for deoxidization thereof and U.S. Pat. No. 2,005,540 introduces treating agents into molten steel by way of a device which is held down in the molten metal by a positioning structure.

This invention takes the form of a plunger of a length comparable with that of the stopper rod of an steel ladle and positioned therein in a similar manner and includes consumable material enabling the timed release of the addition agents at a desirable location in the molten metal in the ladle.

SUMMARY OF THE INVENTION

A ladle for receiving molten metal has a submerged addition agent containing device therein which takes the form of a hollow plunger having a conical closure of consumable material on its lower end containing desulphurization compounds for introduction thereby into the molten steel in the ladle. The construction of the device is such that the disintegration thereof is controlled so that the location and rate of release of the addition agent is most advantageously achieved.

DESCRIPTION OF THE PREFERRED EMBODIMENT

Figure 1:
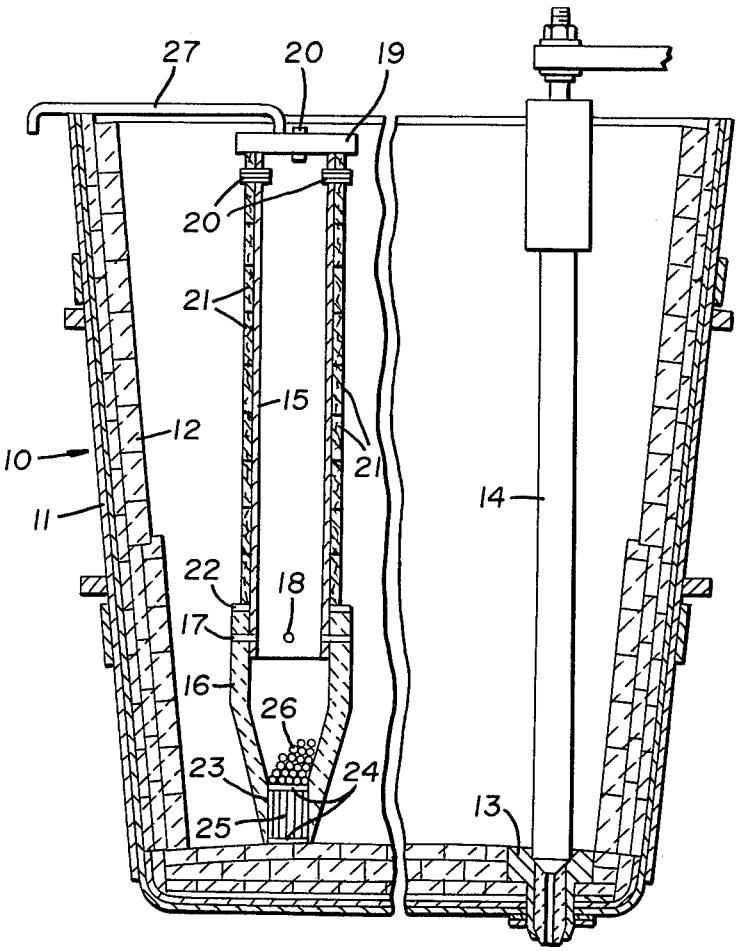
FIG. 1 is a vertical section through a ladle and the submerged agent holding device therein with parts in cross section.

In the form illustrated in FIG. 1 of the drawings, a standard ladle 10 having a metal casing 11, a refractory lining 12, a bottom aperture 13 and a stopper rod 14 terminating in a stopper nozzle is shown. A submerged desulphurization device positioned in the ladle 10 consists of a steel pipe 15 having a cone shaped member 16 detachably secured to the lower end thereof by pins 17 engaging openings 18 in the steel pipe 15. The upper end of the steel pipe 15 is attached to a cap 19 and safety valves or vents 20 are positioned in the steel pipe 15 and the cap 19. A vertically stacked series of insulating rings 21 are positioned around the exterior of the steel pipe 15 from a point immediately beneath the cap 19 to a flange 22 secured to the pipe 15 upwardly from the bottom end thereof and immediately above the upper end of the cone 16. The cone 16 and the insulating rings are formed of non-metallic consumable material that will disintegrate at a constant predetermined rate without any gas build up.

An example of a desirable non-metallic insulating material from which the cone shaped member 16 and the insulating rings 21 may be formed is as follows. A batch including 132 lbs. of dolomite, 16 lbs. of wood chips and 10 lbs. of hydrocarbon resin binder and catalyst therefor such as known in the art as a two-part oil classification polyester resin and a polyisocyanate catalyst available under the trademarks Deep Set Binder CM 2.5 and Deep Set Catalyst FS 100 manufactured by United-Erie Inc. of Erie, Pennsylvania 16512. An alternate composition may comprise 132 lbs. of limestone, 16 lbs. of wood flour and 10 lbs. of the hydrocarbon binder and catalyst as aforesaid. A further modification may comprise a substitution of rice hulls for the wood chips or wood flour. Variations in the amount of the wood chips, wood flour or rice hulls may be used; for example the amount thereof may vary from 8 lbs. to 16 lbs. Variations in the amount of the hydrocarbon resin binder may also be used wherein the total amount of the binder and the catalyst vary between 4 lbs. and 10 lbs.

By referring again to FIG. 1 of the drawings, it will be seen that the insulating rings 21 and the cone shaped member 16 are formed of the material as aforesaid and when shaped are assembled on the steel pipe 15 as aforesaid. The lower end of the cone shaped member 16 is provided with an opening 23 in which a pair of steel plates 24 spaced by a plurality of circumferentially spaced rods 25 are located. The cone shaped member 16 is preferably formed around the plates 24 and the rods 25 so that the same form a closure in the otherwise open lower end of the cone shaped member 11. A desirable quantity of an addition agent such as a suitable desulphurizing compound preferably in the form of pellets 26 is positioned in the cone shaped member 16 and above the uppermost plate 24 and is retained thereby until the timed disintegration of the device in the molten steel. The cone shaped member 16 and rings 21 are sprayed with insulating refractory material.

In forming the cone shaped member 16 and the insulated rings 21 the non-metallic material hereinbefore disclosed is mixed and molded into the desired shapes, dried and when suitably set assembled to the steel pipe 15 as illustrated in FIG. 1 of the drawings and hereinbefore described. A hook arm 27 is attached to the cap 19 of the device so that the outer hook end thereof can engage the rim of the ladle 10 as seen in FIG. 1 of the drawings and thereby holds the device in vertical position in the ladle 10.

Those skilled in the art will observe that the steel plate 24 on the lower end of the device may be positioned in a small puddle of molten steel in the ladle 10 so as to insure positioning of the device in the ladle and preclude floating of the same when the molten steel is placed therein.

The molten steel will cause the disintegration of the non-metallic cone shaped member 16 and the insulating rings 21 at a predetermined rate and thereby release the pellets 26 of the addition agent in a desirable location in the molten steel and at a timed desirable rate of release therein to adequately treat the same. The insulating rings 21 may be formed of a refractory material.

Those skilled in the art will observe that by varying the composition of the non-metallic material hereinbefore referred to, the entire device may be formed thereof and the steel pipe 15 eliminated. Such a modification of the invention may be seen in FIG. 2 of the drawings, and by referring thereto it will be seen that a pipe shaped member 28 of non-metallic consumable material is disclosed having a cap 29 on its uppermost end and safety vents 30 positioned therein and a securing hook 31 attached to the cap 29. The lower end of the pipe shaped member 28 is positioned in a cone shaped hollow member 32 and secured thereto by pins 33 and a quantity of an addition agent in the form of pellets 34 is positioned in the cone shaped hollow member 32, the bottom most portion of which is also formed of plates 35 spaced by a plurality of rods 36. The member 32 may be all consumable.

Figure 2:
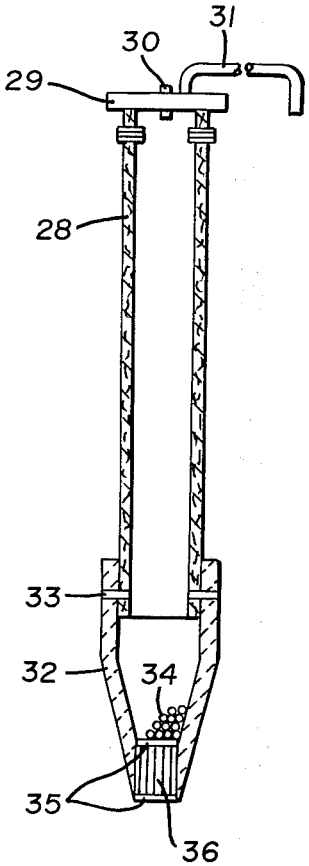
FIG. 2 is a vertical section through a modified form of agent holding device with parts in cross section.

The device of the modification as illustrated in FIG. 2 of the drawings and just described works in the same manner as the device hereinbefore described in connection with FIG. 1 of the drawings, the timed rate of disintegration of the device being controlled by the mix of the non-metallic material.

The ladle and the addition agent device disclosed herein enables the desirable addition of agents to take place with improved efficiencies and without the troublesome smoke and fume problems that have existed in the past.

The weight of the agent holding device is about one and one half times the weight of the molten metal displaced thereby which will insure it's non floating positioning in the molten metal.

From the foregoing it will be seen that the ladle and the submerged addition agent device of the invention acts to properly locate and release treating compounds in the molten metal being treated.

A number of additions, including alloys can be made and the order of the particular addition can be easily controlled by the positioning of the same in the submerged devices disclosed herein. Volatile elements may be added with a controlled rate of introduction and location with a minimum of turbulence and fuming. Since there is far less turbulence in the area of the addition, less oxides will form and, therefore, not only will there be better recoveries of the addition agents, but there will be less sub-surface inclusions in the final product. For the same reason, fines such as ferro manganese fines or ferro silicon fines can be added and they will go into solution rather than blowing off or staying on the top slag and never getting into solution.

Although but two embodiments of the novel part of the combination in the present invention have been illustrated and described, it will be apparent to those skilled in the art that various changes and modifications may be made therein without departing from the spirit of the invention.

I claim:

1. In combination: a refractory lined, apertured ladle for containing a molten metal; means to open and close the aperture of the ladle; a refractory lined rod extending within the ladle and terminating in an enlarged end section at a lower end portion of the ladle; consumable container means carried by the rod at said enlarged end section, said container means comprising a material consisting essentially of about 125 to 135 lbs. of a material selected from the group comprising dolomite and limestone, from 8 lbs. to 16 lbs. of a material selected from the group comprising wood chips, wood flour, and rice hulls, and from 4 lbs. to 12 lbs. of an oil class hydrocarbon resin binder and catalyst for the binder; and an addition agent in said container means for known, predetermined rate of release into molten metal in the ladle to treat the molten metal as the container means is consumed at a known, predetermined rate in the molten metal.

2. The combination as in claim 1, wherein said container means is hollow and has an opening in a lower end thereof and a closure in the opening.

3. The combination as in claim 1, wherein said rod is hollow and has an open upper end and a cover closing the open end.

4. The combination as in claim 1, wherein the rod comprises a section of steel pipe and a jacket of said consumable material on the pipe.

5. The combination as in claim 4, wherein said jacket comprises a plurality of superimposed rings of insulating material.

6. The combination as in claim 1, wherein the container comprises about 132 lbs. of dolomite, 16 lbs. of wood chips and 10 lbs. of a binder and catalyst therefor.

* * * * *